US007114791B2

(12) United States Patent
Umeda

(10) Patent No.: US 7,114,791 B2
(45) Date of Patent: Oct. 3, 2006

(54) HEAD DRIVING DEVICE OF LIQUID JETTING APPARATUS AND METHOD OF DRIVING THE SAME

(75) Inventor: Atsushi Umeda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 114 days.

(21) Appl. No.: 10/409,677

(22) Filed: Apr. 9, 2003

(65) Prior Publication Data

US 2003/0214543 A1 Nov. 20, 2003

(30) Foreign Application Priority Data

Apr. 10, 2002 (JP) ..... P2002-108142

(51) Int. Cl.
*B41J 29/38* (2006.01)

(52) U.S. Cl. ..... 347/9

(58) Field of Classification Search ..... 347/10, 347/14, 68, 54, 9, 67, 11, 12, 8, 5; 330/263–266
See application file for complete search history.

(56) References Cited

U.S. PATENT DOCUMENTS 4,864,249 A * 9/1989 Reiffin ..... 330/263
6,081,280 A * 6/2000 Bolash et al. ..... 347/9
6,286,922 B1 * 9/2001 Kondou ..... 347/10
6,443,547 B1 * 9/2002 Takahashi et al. ..... 347/9
6,657,496 B1 * 12/2003 Chen et al. ..... 330/263

FOREIGN PATENT DOCUMENTS

JP 07-148920 1 6/1995
JP 11-20203 A 1/1999

* cited by examiner

*Primary Examiner*—Stephen Meier
*Assistant Examiner*—Julian D. Huffman
(74) *Attorney, Agent, or Firm*—Sughrue Mion, PLLC

(57) ABSTRACT

A head driving device of a liquid jetting apparatus includes a driving element, respectively provided corresponding to plural nozzles from which a liquid droplet is jetted, a driving waveform generating circuit, generating a driving waveform to drive the driving element selectively at predetermined jetting timing, a current amplifying circuit, amplifying the driving waveform and a current amplifying element, connected in parallel with an amplifying element of the current amplifying circuit. The current amplifying element is operated when a current value of the current amplifying circuit exceeds a predetermined value.

17 Claims, 3 Drawing Sheets

HEAD DRIVING DEVICE OF LIQUID JETTING APPARATUS AND METHOD OF DRIVING THE SAME

BACKGROUND OF THE INVENTION

The present invention relates to the head driving technique of a liquid jetting apparatus wherein current for driving a driving element provided corresponding to a nozzle for jetting a liquid droplet is reduced in a head of the liquid jetting apparatus.

Heretofore, for an output device of a computer, an ink jet color printer of a type that ink in some colors is jetted from a recording head has been popularized and is widely used to print an image processed by a computer and others in multiple colors and multiple gradations.

For example, in an ink jet printer using a piezoelectric element for a driving element for jetting ink, an ink droplet is jetted from a nozzle by dynamic pressure by each piezoelectric element by selectively driving plural piezoelectric elements respectively provided corresponding to plural nozzles of a print head, a dot is formed on printing paper by making the ink droplet adhere onto the printing paper and printing is performed.

Each piezoelectric element is provided corresponding to a nozzle for jetting an ink droplet, is driven by a driving signal supplied from driver IC (a driving waveform generating circuit) mounted in the print head and makes an ink droplet jetted.

FIG. 3 shows such a head driving device. As shown in FIG. 3, a head driving device 1 is composed of a piezoelectric element 2 respectively provided corresponding to plural nozzles of the ink jet printer, the driving waveform generating circuit 3 for supplying a driving signal to one electrode 2*a* of each piezoelectric element 2, a current amplifying circuit 4 and a switching circuit 5 respectively provided between the driving waveform generating circuit 3 and each piezoelectric element 2.

FIG. 3 shows only one piezoelectric element 2, however, actually, plural nozzles are provided to a head of an ink jet printer and one piezoelectric element is provided to each nozzle.

A driving signal COM from the driving waveform generating circuit 3 is actually sequentially output to each piezoelectric element 2 via a shift register and others.

The piezoelectric element 2 is formed so that it is displaced by voltage applied between both electrodes 2*a*, 2*b*.

The piezoelectric element 2 is normally charged so that it is substantially at intermediate potential and is formed so that an ink droplet is jetted from a nozzle because pressure is applied to ink in the corresponding nozzle when the piezoelectric element discharges according to a driving signal COM from the driving waveform generating circuit 3.

The driving waveform generating circuit 3 generates a driving signal COM to be supplied to the head of the ink jet printer and is arranged in the body of the printer or a printer head for example.

The current amplifying circuit 4 is composed of two transistors 4*a*, 4*b*. Of them, for the first transistor 4*a*, the collector is connected to a constant voltage power source, the base is connected to one output terminal of the driving waveform generating circuit 3 and the emitter is connected to the input side of the switching circuit 5. Hereby, the first transistor conducts according to a signal from the driving waveform generating circuit 3 and supplies constant voltage Vcc to the piezoelectric element 2 via the switching circuit 5.

For the second transistor 4*b*, the emitter is connected to the input side of the switching circuit 5, the base is connected to a second output terminal of the driving waveform generating circuit 3 and the collector is grounded. Hereby, the second transistor conducts according to a signal from the driving waveform generating circuit 3 and makes the piezoelectric element 2 discharge via the switching circuit 5.

The switching circuit 5 is turned on at the driving timing of the corresponding piezoelectric element 2 when a control signal is input and outputs a driving signal COM to the piezoelectric element 2.

The switching circuit 5 is actually formed as a so-called transmission gate for turning on or off each piezoelectric element 2.

In the head driving device 1, the current amplifying circuit 4 drives all piezoelectric elements 2 connected to the current amplifying circuit by a pair of transistors 4*a*, 4*b*.

Therefore, as such a transistor that generates maximum current (for example, 30 A) as can supply current required when all piezoelectric elements 2 are simultaneously driven is required to be used for the transistors 4*a*, 4*b*, the transistor requiring a lot of power is required and there is a limit in accelerating.

In the meantime, it is also conceivable that for the two transistors 4*a*, 4*b* forming the current amplifying circuit 4, plural transistors the respective maximum current of which is relatively small are connected by so-called Darlington connection, however, such Darlington connection of transistors has a problem that even if a load is light, waveform distortion is increased

SUMMARY OF THE INVENTION

It is therefore an object of the present invention to provide a head driving device of a liquid jetting apparatus wherein current for a driving signal is amplified, reducing the peak current of a current amplifying circuit with simple configuration.

In order to achieve the above object, according to the present invention, when a current value of the current amplifying circuit exceeds a predetermined value, a current amplifying element connected in parallel with an amplifying element of the current amplifying circuit is operated, amplified current is applied to one electrode of a driving element and the peak current of the current amplifying circuit is reduced.

That is, a head driving device of liquid jetting apparatus, comprising:

- a driving element, respectively provided corresponding to plural nozzles from which a liquid droplet is jetted;
- a driving waveform generating circuit, generating a driving waveform to drive the driving element selectively at predetermined jetting timing;
- a current amplifying circuit, amplifying the driving waveform; and
- a current amplifying element, connected in parallel with an amplifying element of the current amplifying circuit, wherein the current amplifying element is operated when a current value of the current amplifying circuit exceeds a predetermined value.

According to this configuration, in case current flowing in the current amplifying circuit has a small value, a driving signal from the driving waveform generating circuit is amplified by the current amplifying circuit and is applied to one electrode of each driving element.

In the meantime, when a driving signal from the driving waveform generating circuit grows and current flowing in the current amplifying circuit has a large value correspondingly, the current amplifying element connected in parallel with the amplifying element of the current amplifying circuit is operated, amplified current flows to one electrode of each driving element as a second driving signal and voltage is applied.

Therefore, as current from both the current amplifying circuit and the current amplifying element flows to each driving element when current flowing in the current amplifying circuit exceeds a predetermined value, the peak current of the current amplifying circuit can be reduced and the amplifying element made of a transistor and forming the current amplifying circuit requires only small power.

Hereby, as the cost of the current amplifying circuit can be reduced and Darlington connection and others are not required, waveform distortion can be also reduced and the precision of a driving waveform is enhanced.

Also, the extremely excellent head driving device of the liquid jetting apparatus wherein the current of a driving signal is amplified with simple configuration, reducing the peak current of the current amplifying circuit is provided.

Preferably, the head driving device further comprises a current detecting circuit, detecting that a current value of the current amplifying circuit exceeds a predetermined value. The current amplifying element is operated when the current detecting circuit detects a current value exceeding the predetermined value.

According to this configuration, when a driving signal from the driving waveform generating circuit grows and current flowing in the current amplifying circuit has a large value correspondingly, the current detecting circuit detects this and the current amplifying element is operated. Hereby, current amplified by the current amplifying element flows to one electrode of each driving element as a second driving signal and voltage is applied.

Here, it is preferably that, the current detecting circuit is formed by a resistor connected to the current amplifying circuit in series. Voltage generated in the resistor is applied to a control electrode of the current amplifying element.

According to this configuration, the voltage of the resistor applied to the control electrode exceeds a threshold and the current amplifying element is operated by setting voltage generated in the resistor by current equivalent to a predetermined value of the current amplifying circuit to a threshold of the current amplifying element. Therefore, current amplified by the current amplifying element flows to one electrode of each driving element as a second driving signal and voltage is applied.

Here, it is preferably that, the current amplifying element is formed by a transistor. The base of the transistor functions as the control electrode.

According to this configuration, when a driving signal from the driving waveform generating circuit grows and current flowing in the current amplifying circuit has a large value correspondingly, voltage generated in the resistor as a current detecting circuit exceeds predetermined voltage and is applied to the base of the transistor. Hereby, the transistor is turned on and the operation is started.

Here, it is preferably that, the current amplifying element is formed by a field effect transistor (FET). The gate of the field effect transistor functions as the control electrode.

According to this configuration, when a driving signal from the driving waveform generating circuit grows and current flowing in the current amplifying circuit has a large value correspondingly, voltage generated in the resistor as a current detecting circuit exceeds predetermined voltage and is applied to the gate of FET. Hereby, FET is turned on and the operation is started.

In this case, as FET is used for a current amplifying element, a value of allowable peak current becomes large, compared with a case that a transistor is used and more current can be made to flow.

Preferably, a voltage waveform of the current amplifying element is formed alike by a resistor element and a capacitor element.

According to the present invention, there is also provided a method of driving a head driving device, comprising the steps of:

providing a first current amplifying circuit;

providing a second current amplifying circuit;

providing a driving element;

generating a driving waveform to drive the driving element;

amplifying the driving waveform by the first current amplifying circuit;

amplifying a part of a current to be supplied to the first current by the second current amplifying circuit when a current flowing through the first current amplifying circuit exceeds a predetermined value; and supplying the driving waveform amplified by the first current amplifying circuit and the part of the current amplified by the second current amplifying circuit to the driving element.

Preferably, the method further comprises the step of detecting the current value of the current flowing through the first current amplifying circuit exceeds the predetermined value.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENT

Figure 1:
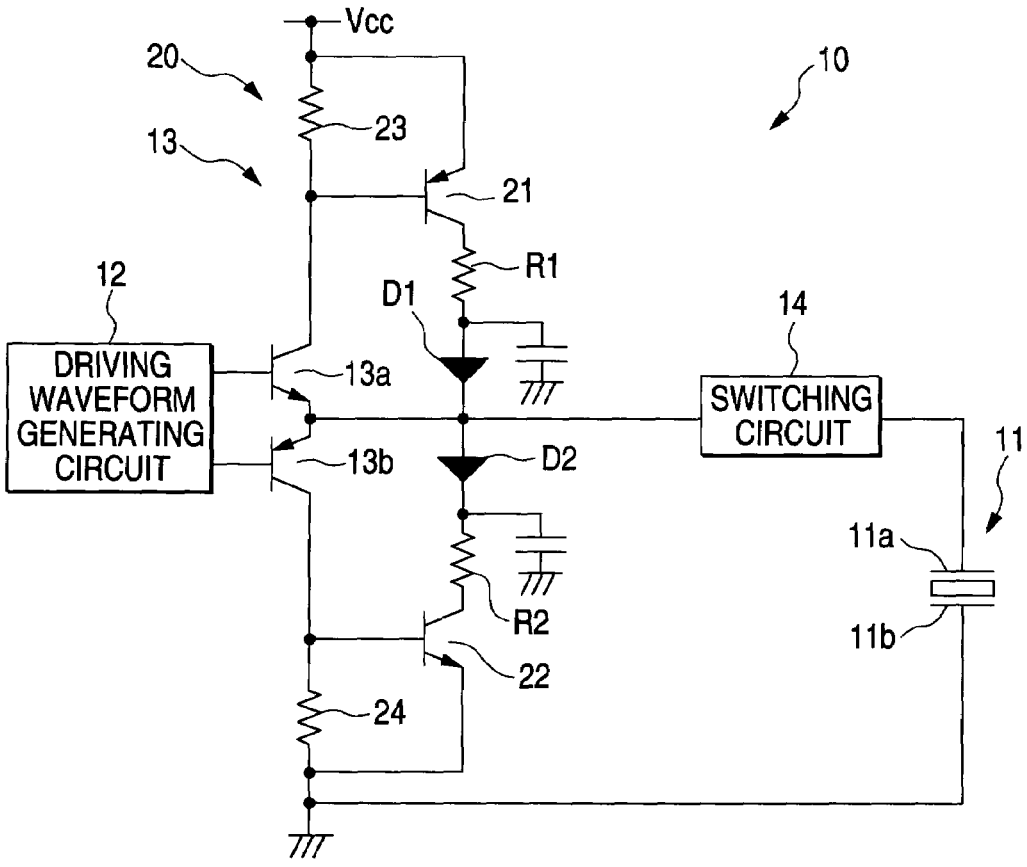
FIG. 1 is a block diagram showing the configuration of one embodiment of a head driving device of an ink jet printer according to the invention.

Referring to the drawings, a head driving device of an ink jet printer according to an embodiment of the invention will be described below as one example of the head driving device of the liquid jetting apparatus.

As the embodiment described below is a preferred concrete example of the invention, technically desirable various limits are set, however, the scope of the invention is not limited to the embodiment unless it is described below that the invention is limited.

FIG. 1 shows the configuration of a head driving device of an ink jet printer according to one embodiment of the invention.

As shown in FIG. 1, the head driving device 10 is composed of a piezoelectric element 11 as a driving element respectively provided corresponding to plural nozzles of a printer head, a driving waveform generating circuit 12 for supplying a first driving signal COMA to one electrode 11*a* of each piezoelectric element 11, a current amplifying circuit 13 and a switching circuit 14 respectively provided between the driving waveform generating circuit 12 and each piezoelectric element 11, a current detecting circuit 20 for detecting a current value of the current amplifying circuit 13 and current amplifying elements 21, 22 connected in parallel with the current amplifying circuit 13.

As shown in FIG. 1, the piezoelectric element 11 is actually provided to each nozzle row provided every color in the printer head of the ink jet printer.

A first driving signal COMA output from the driving waveform generating circuit 12 is actually sequentially output to the piezoelectric element of each nozzle row via a shift register and others.

The piezoelectric element 11 is formed so that it is displaced by voltage applied between both electrodes 11*a* and 11*b*.

The piezoelectric element 11 is formed so that an ink droplet is jetted from a nozzle because pressure is applied to ink in the corresponding nozzles when the piezoelectric element discharges based upon the sum of the voltage of a first driving signal COMA from the driving waveform generating circuit 12 and a second driving signal COMB (described later) from the current amplifying elements 21, 22.

The driving waveform generating circuit 12 generates a first driving signal COMA to be supplied to the head of the ink jet printer and is mounted in a controller for the body of the printer or the printer head.

The current amplifying circuit 13 is composed of two transistors 13*a*, 13*b*.

Of them, for the first transistor 13*a*, the collector is connected to a constant voltage power source via a first resistor 23 of the current detecting circuit 20, the base is connected to one output terminal of the driving waveform generating circuit 12 and the emitter is connected to the input side of the switching circuit 14. Hereby, the first transistor conducts according to a signal from the driving waveform generating circuit 12 and supplies constant voltage Vcc to the piezoelectric element 11 via the resistor 23 and the switching circuit 14.

For the second transistor 13*b*, the emitter is connected to the input side of the switching circuit 14, the base is connected to a second output terminal of the driving waveform generating circuit 12 and the collector is grounded via a second resistor 24 of the current detecting circuit 20. Hereby, the second transistor conducts according to a signal from the driving waveform generating circuit 12 and makes the piezoelectric element 11 discharge via the switching circuit 14.

The switching circuit 14 is actually formed as a so-called transmission gate for turning on or off each piezoelectric element 11.

The current detecting circuit 20 is composed of the two resistors 23, 24 connected in series respectively between the collector of the first transistor 13*a* and the constant voltage power source and between the emitter of the second transistor 13*b* and the ground so as to detect a current value respectively on the side of the constant voltage power source of the current amplifying circuit 13 and on the ground side.

The first current amplifying element 21 is formed by a third transistor connected in parallel with the first transistor 13*a*, the emitter is connected to the constant voltage power source, the base is connected to the first resistor 23 on the side of the first transistor 13*a* and the collector is connected to the input side of the switching circuit 14 via a resistor R1 and a diode D1.

Hereby, the third transistor 21 is turned on when the voltage of the first resistor 23 exceeds a predetermined value and amplified current flows on the input side of the switching circuit 14 via the resistor R1 and the diode D1 from the constant voltage power source as a second driving signal COMB.

The second current amplifying element 22 is formed by a fourth transistor connected in parallel with the second transistor 13*b*, the collector is connected to the input side of the switching circuit 14 via a diode D2 and a resistor R2, the base is connected to the second resistor 24 on the side of the second transistor 13*b* and the emitter is grounded.

Hereby, the fourth transistor 22 is turned on when the voltage of the second resistor 24 exceeds a predetermined value and makes the piezoelectric element 11 discharge through the switching circuit 14 via the diode D2 and the resistor R2 from the input side of the switching circuit 14.

The head driving device 10 according to the embodiment of the invention is configured as described above and operates as follows.

As a value of current amplified by the current amplifying circuit 13 is also small normally, that is, in case a driving signal COMA from the driving waveform generating circuit 12 is small, the voltage of the resistors 23, 24 forming the current detecting circuit 20 is low. Therefore, the current amplifying elements 21, 22, that is, the third and fourth transistors are kept off.

However, according to the variation of a driving signal COMA from the driving waveform generating circuit 12, in case driving voltage is higher than intermediate potential, one electrode 11*a* of the piezoelectric element 11 is charged via the first transistor 13*a* of the current amplifying circuit 13. Also, in case driving voltage is lower than intermediate potential, one electrode 11*a* of the piezoelectric element 11 is discharged via the second transistor 13*b* of the current amplifying circuit 13. Hereby, the piezoelectric element 11 is operated according to the driving signal COMA and an ink droplet is jetted.

In the meantime, in case a driving signal COMA from the driving waveform generating circuit 12 is large, a value of current amplified by the current amplifying circuit 13 correspondingly also becomes large. When the voltage of the resistors 23, 24 forming the current detecting circuit 20 rises and exceeds a predetermined value, each base voltage of the third and fourth transistors which function as the current amplifying elements 21, 22 exceeds a threshold. Therefore, the third and fourth transistors are turned on.

Hereby, driving signals COMB from the current amplifying elements 21, 22 are applied to the piezoelectric element 11 in addition to a driving signal COMA from the current amplifying circuit 13. Therefore, the peak current of the current amplifying circuit 13 can be reduced.

Figures 2A, 2B, 2C, 2D:
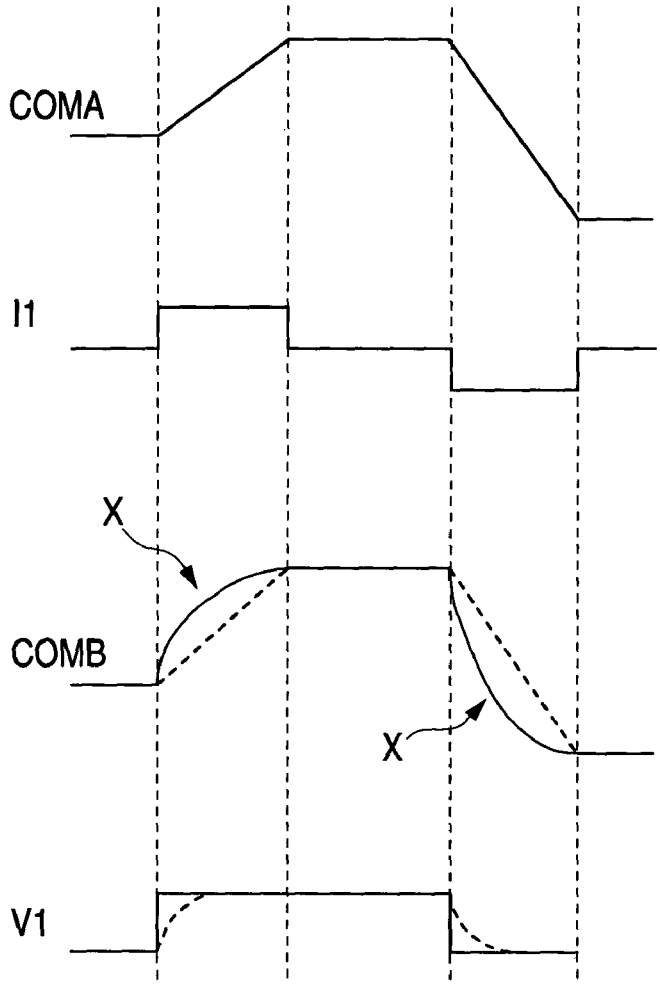
FIG. 2 are graphs showing a driving signal COMA (2A) from a current amplifying circuit in the head driving device shown in FIG. 1, current I1 (2B) output from the current amplifying circuit, a driving signal COMB (2C) from a current amplifying element and voltage V1 (2D) output from the current amplifying element.
Figure 3:
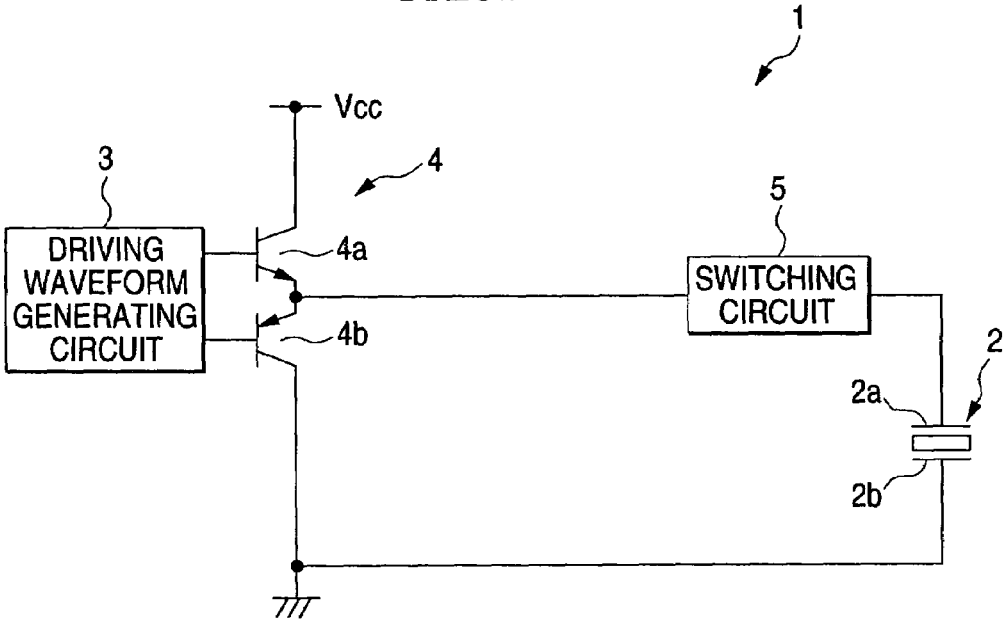
FIG. 3 PRIOR ART
FIG. 3 is a block diagram showing the configuration of one example of a conventional type head driving device.

In this case, the current amplifying circuit 13 is also operated, the output voltage, that is, the driving signal COMA and the output current I1 of the current amplifying circuit 13 are shown in FIGS. 2A and 2B, and the voltage of the driving signal COMA is gradually increased by output current I1 that flows in the first transistor 13*a* or the voltage of the driving signal COMA is gradually reduced by output current I1 that flows in the second transistor 13*b*.

In the meantime, the output voltage, that is, a driving signal COMB and the output voltage V1 of the third and fourth transistors which function as the current amplifying elements 21, 22 are shown in FIGS. 2C and 2D.

In the waveform of the driving signal COMB, the swell shown by a letter X in FIG. 2D occurs when output voltage V1 increases and decreases, however, the swell when output voltage V1 increases is shaped by turning on the second transistor 13*b* on the discharge side and output voltage increases with a substantially fixed inclination. The swell when output voltage decreases is similarly shaped by turning on the first transistor 13*a* on the charge side and the waveform of the driving signal COMB lowers with a substantially fixed inclination.

As described above, according to the head driving device 10 of the embodiment of the invention, when a current value of the current amplifying circuit 13 exceeds a predetermined value, the current amplifying elements 21, 22 are operated and a driving signal COMB is applied to the piezoelectric element 11 in addition to a driving signal COMA from the current amplifying circuit 13. Therefore, the current value of the current amplifying circuit 13 is limited to the predetermined value.

Hereby, as each transistor 13*a*, 13*b* forming the current amplifying circuit 13 has only to amplify relatively small current, a miniaturized low-cost transistor can be used.

As each transistor functioning as the current amplifying elements 21, 22 is operated only when a current value of the current amplifying circuit 13 exceeds a predetermined value, a high-precision transistor is not required and a low-cost transistor can be used.

Therefore, according to the embodiment described above, as current can be amplified by each transistor 13*a*, 13*b* on the charge side and on the discharge side in case a current value of the current amplifying circuit 13 is small, a high-precision waveform is acquired.

Further, in case a current value of the current amplifying circuit 13 is large, the current value of the current amplifying circuit 13 is complemented by current that flows in the third and fourth transistors as the current amplifying elements 21, 22 respectively connected in parallel with each transistor 13*a*, 13*b* of the current amplifying circuit 13. Therefore, the current value of the current amplifying circuit 13 is limited to a relatively small value, a low-cost transistor requiring only relatively small power can be used for each transistor 13*a*, 13*b* of the current amplifying circuit 13.

In the embodiment described above, the third and fourth transistors are used for the current amplifying elements 21, 22, however, the invention is not limited to these and another amplifying element such as FET may be also used.

In case FET is used, more current can be made to flow because allowable peak current increases, compared with the case of a transistor Besides, in the embodiment described above, the piezoelectric element 11 is used for a driving element, however, the invention is not limited to this and another piezoelectric element such as an electrostrictive element and a magnetostrictive element may be also used. Further, it is natural that the invention can be also applied to an ink jet printer of a system that a resistor as a driving element is heated by making current flow and an ink droplet is jetted by the pressure of a bubble generated in ink by heating.

Besides, in the embodiment described above, the piezoelectric element 11 is used for a driving element, however, the invention is not limited to this and another piezoelectric element such as an electrostrictive element and a magnetostrictive element may be also used. Further, it is natural that the invention can be also applied to an ink jet printer of a system that a resistor as a driving element is heated by making current flow and an ink droplet is jetted by the pressure of a bubble generated in ink by heating.

What is claimed is:

1. A head driving device of a liquid jetting apparatus, comprising:

a driving element, respectively provided corresponding to plural nozzles from which a liquid droplet is jetted;

a driving waveform generating circuit, generating a driving waveform to drive the driving element selectively at predetermined jetting timing;

a current amplifying circuit, amplifying the driving waveform; and a current amplifying element, connected in parallel with an amplifying element of the current amplifying circuit, wherein the current amplifying element is operated when a current value of the current amplifying circuit exceeds a predetermined value, wherein a first driving waveform from the current amplifying circuit and a second driving waveform from the current amplifying element, are supplied to the driving element, wherein a resistor and a diode connected in series to each other are arranged between the current amplifying element and the driving element, and wherein a grounded capacitor is connected to a connection point between the resistor and the diode.

2. The head driving device as set forth in claim 1, further comprising, a current detecting circuit, detecting that a current value of the current amplifying circuit exceeds a predetermined value, and wherein the current amplifying element is operated when the current detecting circuit detects a current value exceeding the predetermined value.

3. The head driving device as set forth in claim 2, wherein the current detecting circuit is formed by a resistor connected to the current amplifying circuit in series; and wherein voltage generated in the resistor is applied to a control electrode of the current amplifying element.

4. The head driving device as set forth in claim 3, wherein the current amplifying element is formed by a transistor; and wherein the base of the transistor functions as the control electrode.

5. The head driving device as set forth in claim 3, wherein the current amplifying element is formed by a field effect transistor (FET); and wherein the gate of the field effect transistor functions as the control electrode.

6. The head driving device as set forth in claim 1, wherein a voltage waveform of the current amplifying element is formed alike by a resistor element and a capacitor element.

7. The head driving device as set forth in claim 1, wherein:

the driving element is a piezoelectric element comprising a first and a second electrode;

the current amplifying circuit comprises a first transistor, with a collector connected to a constant voltage power source via a first resistor of a current detecting circuit, and a second transistor, with a collector grounded via a second resistor of the current detecting circuit;

the current amplifying element comprises a third transistor connected in parallel with the first transistor, and a fourth transistor connected in parallel with the second transistor, the third transistor having an emitter connected to the constant voltage power source and the fourth transistor having an emitter grounded; and emitters of the first and the second transistors supplying respective signals to the driving element;

when the first resistor of the current detecting circuit determines that a current supplied to the first transistor exceeds a predetermined value, the current from the first resistor is supplied to a base of the third transistor, and the third transistor via its collector supplies a signal to the driving element; and when the second resistor of the current detecting circuit determines that a current supplied to the second transistor exceeds a predetermined value, the current from the second resistor is supplied to a base of the fourth transistor, and the fourth transistor via its collector supplies a signal to the driving element.

8. The head driving device as set forth in claim 7, wherein the collectors of the third and fourth transistors supply the signal to the driving element via a grounded resistor and a diode.

9. The head driving device as set forth in claim 8, further comprising a switching circuit turning on and off the driving element based on the signals supplied from the current amplifying circuit and the current amplifying element.

10. The head driving device as set forth in claim 1, wherein the current amplifying element comprises a first resistor and wherein a current of the current amplifying circuit is detected via a second resistor.

11. The head driving device as set froth in claim 1, wherein the current amplifying element comprises a resistor.

12. The head driving device according to claim 1, wherein the current of the current amplifying circuit is detected via a resistor.

13. The head driving device according to claim 1, wherein the current amplifying element comprises a diode.

14. The head driving device according to claim 1, wherein the current amplifying element supplies a signal to the driving element via a resistor and a diode.

15. The head driving device according to claim 14, wherein the resistor is grounded.

16. The head driving device according to claim 1, wherein, for each transistor of the current amplifying circuit, a detecting circuit detecting current of respective transistor is provided and a respective transistor of the current amplifying element is provided and wherein each transistor of the current amplifying element supplies a signal to the driving element via a resistor.

17. The head driving device according to claim 16, wherein the resistor is grounded and wherein said each transistor of the current amplifying element supplies the signal to the driving element via the resistor and a diode.

* * * * *